US007331460B2

(12) United States Patent
Barndt et al.

(10) Patent No.: US 7,331,460 B2
(45) Date of Patent: Feb. 19, 2008

(54) SHIELDED MEDICAMENT PACKAGE

(75) Inventors: David R. Barndt, Richlandtown, PA (US); Dennis H. Chadwick, Ottsville, PA (US); Victor Gherdan, Jr., Cherry Hill, NJ (US)

(73) Assignee: R.P. Scherer Technologies, Inc., Las Vegas, NV (US)

( * ) Notice: Subject to any disclaimer, the term of this patent is extended or adjusted under 35 U.S.C. 154(b) by 207 days.

(21) Appl. No.: 11/325,364

(22) Filed: Jan. 4, 2006

(65) Prior Publication Data

US 2007/0151893 A1 Jul. 5, 2007

(51) Int. Cl.
*B65D 83/04* (2006.01)

(52) U.S. Cl. ..... 206/531; 206/532

(58) Field of Classification Search ..... 206/528, 206/529, 530, 531, 532, 534.1, 538, 539, 206/828

See application file for complete search history.

(56) References Cited

U.S. PATENT DOCUMENTS

| | | | | |
|---|---|---|---|---|
| 6,021,901 | A | 2/2000 | Wolfe | 206/531 |
| 6,036,018 | A | 3/2000 | Harrold | 206/536 |
| 6,098,835 | A | 8/2000 | DeJonge | 221/25 |
| 6,375,956 | B1 | 4/2002 | Hermelin et al. | 424/400 |
| 6,460,693 | B1 | 10/2002 | Harrold | 206/1.5 |
| 6,529,446 | B1 | 3/2003 | de la Huerga | 368/10 |
| 6,726,053 | B1 | 4/2004 | Harrold | 221/25 |
| 6,805,258 | B2 | 10/2004 | Cross | 221/25 |
| 6,854,618 | B2 | 2/2005 | Harrold | 221/25 |
| 6,978,894 | B2 | 12/2005 | Mundt | 206/534 |
| 6,988,618 | B2 | 1/2006 | DeJonge | 206/528 |
| 7,000,769 | B2 | 2/2006 | Killinger | 206/534 |
| 2005/0211597 | A1* | 9/2005 | Penfold et al. | 206/531 |
| 2006/0102512 | A1* | 5/2006 | Lo Duca | 206/531 |
| 2006/0118452 | A1* | 6/2006 | Gattefosse et al. | 206/531 |

* cited by examiner

*Primary Examiner*—Jacob K. Ackun, Jr.
(74) *Attorney, Agent, or Firm*—Fitzpatrick, Cella, Harper & Scinto

(57) ABSTRACT

A shielded medication package including a blister portion and a blister shield attached to a backing substrate. Accessing a medicament is easy for an adult to accomplish, yet the package resists children biting and picking at the blister portion. The blister portion contains a base layer and a blister layer. The blister layer includes an article receiving blister designed for holding the medicament. A blister shield overlays the blister portion. The blister shield includes a blister well that cooperates with the article receiving blister. The blister shield protects the article receiving blister from substantially lateral forces. To eject the medicament, application of a substantially orthogonal force to the article receiving blister is required.

28 Claims, 14 Drawing Sheets

SHIELDED MEDICAMENT PACKAGE

TECHNICAL FIELD

The present invention generally relates to medication packages and, more particularly, relates to child resistant medication packages that incorporate a protective shielding component.

BACKGROUND OF THE INVENTION

There is a continued need for medication packages that are child resistant and specifically resistant to children that bite or otherwise use their fingers to gain access to potentially harmful medication. In addition, there is also a desire to have medication packages that allow the average adult to see the medication contained in the package but retain an acceptable or aesthetic visual appearance after multiple medicaments have been removed from the package. There is also a need to make this type of package economical to manufacture.

Over the years, a wide variety of disposable medication packages have been suggested which are accessible through a variety of folding, stripping, rupturing, peeling, and/or tearing procedures. These packages have typically been formed of transparent top layers which are sealed or otherwise bonded to backing layers in a manner which provides a cavity, pouch or "blister" in which the medicament resides. The top and backing layers may be formed of flexible packaging materials, rigid thermoformable plastic materials, foil, paper, laminates, or combinations thereof. Medicament cavities formed between such layers have been accessed by tearing into them from an edge of the package, which tearing may or may not be facilitated through the provision of a starting notch or slit, or by simply pushing on the blister until the medicament breaks through the backing layer. Alternatively, these cavities may be accessed by stripping a backing layer from the package to expose the cavity, or to expose a push-through underlayer. In other instances, the backing layer is made of foil that can be ruptured when the medication in the blister is pushed against the backing layer. Generally, these packages are tamper evident, but typically not child resistant. Other medication packages require some form of peeling of the bottom surface from the top surface to get access to the medication.

Child resistant medication packages that have blisters have been in use for some time, however, as is too often the case, "child resistant" simply means that many people who do not have sufficient motor skills, finger strength, or whose hands shake are not able to easily gain access to the medicament in such packages. Children, however, do not generally limit themselves to the use of their fingers to open containers or packages. Usually after failing to open an object, children readily resort to more destructive methods to overcome child resistant features. For smaller packages, or for features that are accessible, for example, a blister containing a pill, children will use their teeth to destroy a protective barrier. This can be a problem especially when the protective, child-resistant features of the package are small enough to allow a child to place the protective barrier in their mouth.

There is a need for a medication package that is relatively easy to open for an adult, but still child resistant. Further, the package must remain visually appealing after several medicaments have been removed. And furthermore, the package must be easy to manufacture without having to introduce custom machinery, so that the package remains economical.

The present invention has accomplished these needs by creating a medication package that does not require fine motor skill functions, such as pinching and peeling. The present invention is relatively easy to open by application of substantially orthogonal pressure on the medicament blister, retains its visual appeal after multiple uses, and yet will substantially fend off direct biting assaults made by children.

SUMMARY OF THE INVENTION

In its most general configuration, the present invention advances the state of the art with a variety of new capabilities and overcomes many of the shortcomings of prior devices. In its most general sense, the present invention overcomes the shortcomings and limitations of the prior art in any of a number of generally effective configurations.

The shielded child resistant medicament package of the present invention is designed for housing a solid medicament. The package includes a blister portion sandwiched between a backing substrate and blister shield. The package may also include a dispensing substrate and a retaining substrate. The arrangement of the three primary components is unique and requires application of a force on the blister portion to access the medicament. The blister shield prevents access to the blister portion other than by pressure on the top of the blister portion. Consequently, any attempts to pick at or bite the blister portion from the side are thwarted by the blister shield. A child cannot bite or pinch the blister containing the medicament.

The blister portion contains a base layer and a blister layer. The blister layer is formed to include an article receiving blister designed for holding the medicament. Generally, at least five percent of the surface area of a base layer interior surface is joined to a blister layer interior surface thereby sealing the medicament in the article receiving blister. The area of the blister layer that is formed into the article receiving blister is not joined to the base layer.

The blister shield is formed with a blister well. The blister well is generally shaped to cooperate with the article receiving blister. The blister well is positioned so that it prevents access to the sides of the article receiving blister but provides access to the top of the article receiving blister. Therefore, application of pressure to the top of the article receiving blister is required to remove the medicament.

The backing substrate is formed to have an article dispensing region. The article dispensing region is configured to cooperate with the blister portion. In other words, the article receiving blister and the article dispensing region must generally align such that when the medicament is ejected from the article receiving blister the medicament may pass through the article dispensing region.

The assembly and orientation of the various elements of the package imparts the desired functionality to achieve the child resistance, aesthetics, and operation necessary to open the package. To dispense the medicament from the package requires application of a substantially orthogonal force to the exposed portion of the article receiving blister. Generally, the force will be applied by a tip of a human digit, most likely the thumb. The force is applied from the blister shield side of the package. The shield protects the sides of the article receiving blister. The blister shield may be solid or may be formed as a shell with supporting contact points.

Thus, there is disclosed a shielded child resistant medicament package (10) for housing a medicament (M), comprising:

(a) a blister portion having:

(i) a base layer having a base layer perimeter, a base layer exterior surface, and a base layer interior surface;

(ii) a blister layer having a blister layer perimeter, a blister layer exterior surface, a blister layer interior surface, and including an article receiving blister, having a blister perimeter and a blister height, formed therein, wherein the article receiving blister is designed for holding the medicament; wherein (iii) at least five percent of the surface area of the base layer interior surface is joined to the blister layer interior surface thereby sealing the medicament in the article receiving blister;

(b) a blister shield having a blister shield thickness, a blister shield support bearing edge, a blister shield top surface, and a blister shield bottom surface, wherein the blister shield is formed with a blister well having a well interior perimeter such that the blister well cooperates with the article receiving blister;

(c) a backing substrate having a backing substrate perimeter, a backing substrate interior surface, and a backing substrate exterior surface, wherein the backing substrate is formed to have an article dispensing region having an article dispensing region perimeter, wherein the article dispensing region is configured to cooperate with the blister portion; and (d) wherein the blister portion is located between the blister shield and the backing substrate such that the article receiving blister, the blister well, and the article dispensing region substantially align and the blister well cooperates with the article receiving blister to shield, in part, the article receiving blister from the application of substantially lateral forces thereby preventing access to the medicament via compromise of the article receiving blister and requiring application of a substantially orthogonal force to the article receiving blister to result in the medicament breaking through the base layer, and passing out of the article dispensing region.

Thus, there is further disclosed a shielded child resistant medicament package for housing a medicament, comprising:

(a) a blister portion having:

(i) a base layer having a base layer perimeter, a base layer exterior surface, and a base layer interior surface;

(ii) a blister layer having a blister layer perimeter, a blister layer exterior surface, a blister layer interior surface, and including an article receiving blister, having a blister perimeter and a blister height, formed therein, wherein the article receiving blister is designed for holding the medicament; wherein (iii) at least five percent of the surface area of the base layer interior surface is joined to the blister layer interior surface thereby sealing the medicament in the article receiving blister;

(b) a dispensing substrate having a dispensing substrate perimeter, a dispensing substrate interior surface, a dispensing substrate exterior surface, and the dispensing substrate is formed to have a dispensing substrate blister receiver;

(c) a blister shield having a blister shield support bearing edge, a blister shield top surface, a blister shield bottom surface, a blister well, and a blister shield height; wherein (i) the blister well is formed with a well interior perimeter such that the blister well cooperates with the article receiving blister; and wherein (ii) the blister shield height is substantially equal to the blister height;

(d) a backing substrate having a backing substrate perimeter, a backing substrate interior surface, and a backing substrate exterior surface, wherein the backing substrate is formed to have an article dispensing region having an article dispensing region perimeter, wherein the article dispensing region is configured to cooperate with the blister portion;

(e) a retaining substrate having a retaining substrate interior surface, a retaining substrate exterior surface, and a retaining substrate blister receiver that is designed to cooperate with the blister portion; and (f) wherein the blister portion lies between the backing substrate and the retaining substrate with the blister shield held in place by the dispensing substrate, and wherein the article receiving blister, the blister well, and the article dispensing region substantially align and the blister well cooperates with the article receiving blister to shield, in part, the article receiving blister fro the application of substantially lateral forces thereby preventing access to the medicament via compromise of the article receiving blister and requiring application of a substantially orthogonal force to the article receiving blister to result in the medicament breaking through the base layer, and passing out of the article dispensing region.

Various objects and advantages of the present invention will become apparent from the following detailed description when viewed in conjunction with the accompanying drawings, which set forth certain embodiments of the invention.

BRIEF DESCRIPTION OF THE DRAWINGS

Without limiting the scope of the present invention as claimed below and referring now to the drawings and figures:

DETAILED DESCRIPTION OF THE INVENTION

The child resistant medicament package of the instant invention provides a significant advance in the state of the art. The preferred embodiments of the apparatus accomplish this by new and novel arrangements of elements that are configured in unique and novel ways and which demonstrate previously unavailable but desirable capabilities. The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
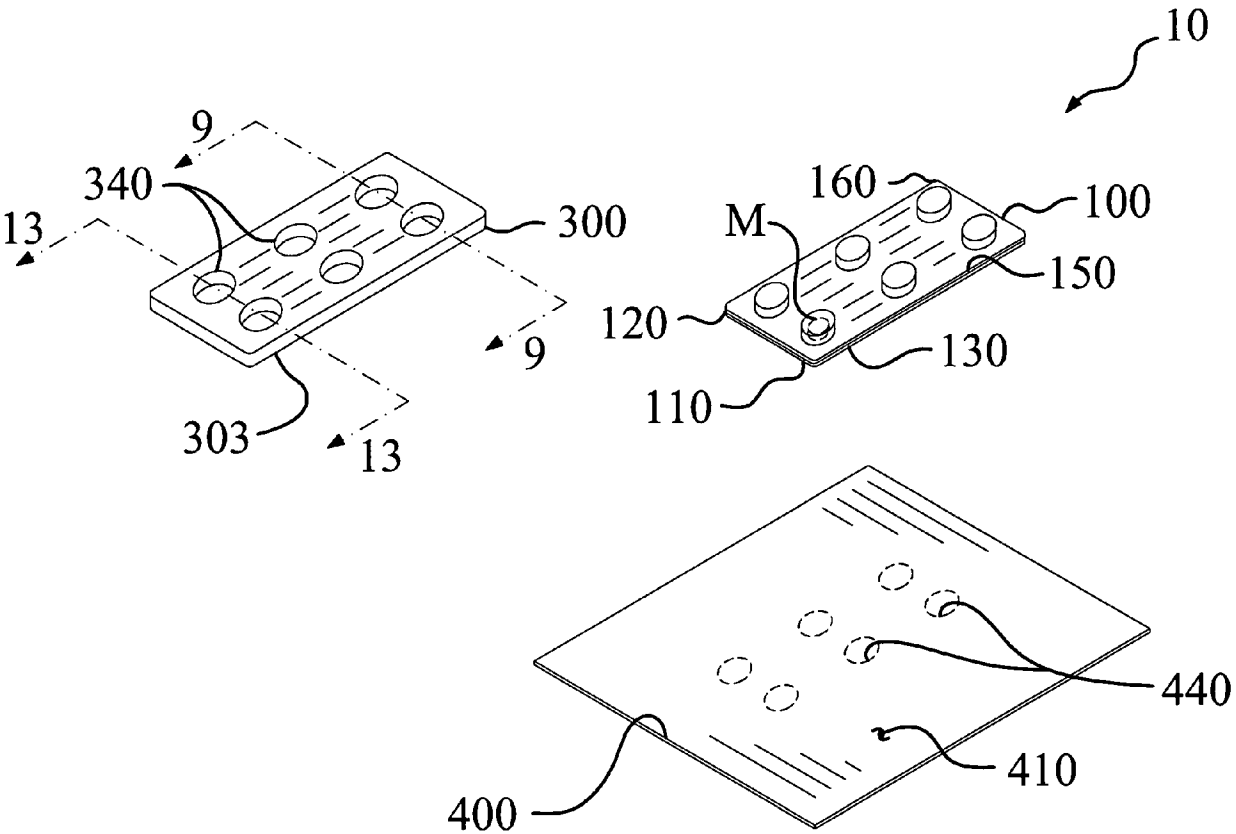
FIG. 1 is a perspective view of the components of the shielded child resistant medicament package, not to scale.

The shielded child resistant medicament package (10) of the present invention is designed for housing a solid medicament (M) regardless of form, including, but not limited to, round pills, oval pills, oblong capsules, caplets, etc. As seen in FIG. 1, the package (10) includes a blister portion (100), a blister shield (300), and a backing substrate (400). These three primary components are assembled in a way that requires the application of a substantially orthogonal force to access the medicament (M). In addition, the package (10) prevents children from biting or picking off portions of the package (10) to gain access to the medicament (M). The characteristics of the three primary components will be briefly described so that the sequence of operation may be explained.

First, the blister portion (100) contains a base layer (110) and a blister layer (150). The base layer (110) has a base layer perimeter (120), a base layer exterior surface, and a base layer interior surface (140), labeled in FIGS. 1 and 5. Similarly, the blister layer (150) has a blister layer perimeter (160), a blister layer exterior surface (170), and a blister layer interior surface (180), also labeled in FIGS. 1, 2, and 5. The blister layer (150) is formed to include an article receiving blister (190) having a blister perimeter (196), best illustrated in FIG. 2. The article receiving blister (190) has a blister height (198) and is formed with a sidewall (192) and an endwall (194) and is designed for holding the medicament (M), illustrated in FIG. 5.

The blister layer (150) is preferably made of pharmaceutical grade PVC or other thermoplastic material, such as polypropylene, polyethylene, styrene, cold-formed foil, or other suitable materials for packaging. The article receiving blister (190) may be formed by a thermoforming process in which the blister layer (150) material is stretched into a cavity with a vacuum technique to form the blister portion. In a preferred embodiment, a sheet of suitable material for the blister layer (150) is exposed to heating elements for a pre-determined time. This sheet is then trapped in a forming station where it is subjected to both vacuum and pressure. During this process, the material may also be mechanically assisted into the blister cavity via a matched metal plug to form the article receiving blister (190). In another embodiment, the article receiving blister (190) may be formed by using cold-formed foil and cold-form packaging processes. The base layer (110) may be comprised of one or more separate layers of material, such as foil and polyester or other suitable foils. The base layer (110) is typically comprised of multiple layers, but it could be made of any material.

Referring again to FIG. 5, at least five percent of the surface area of the base layer interior surface (140) is joined to the blister layer interior surface (180) thereby sealing the medicament (M) in the article receiving blister (190). The blister layer (150) may be joined to the base layer (110) by heat sealing, adhesive such as heat-activated adhesive that has been pre-applied to the base layer (110) or solvent adhesive, radio frequency or sonic seal, or by other suitable means. The area of the blister layer (150) that is formed into the article receiving blister (190) is not joined to the base layer (110). The blister layer perimeter (160) generally corresponds to the base layer perimeter (120), shown in FIG. 1.

Figure 2:
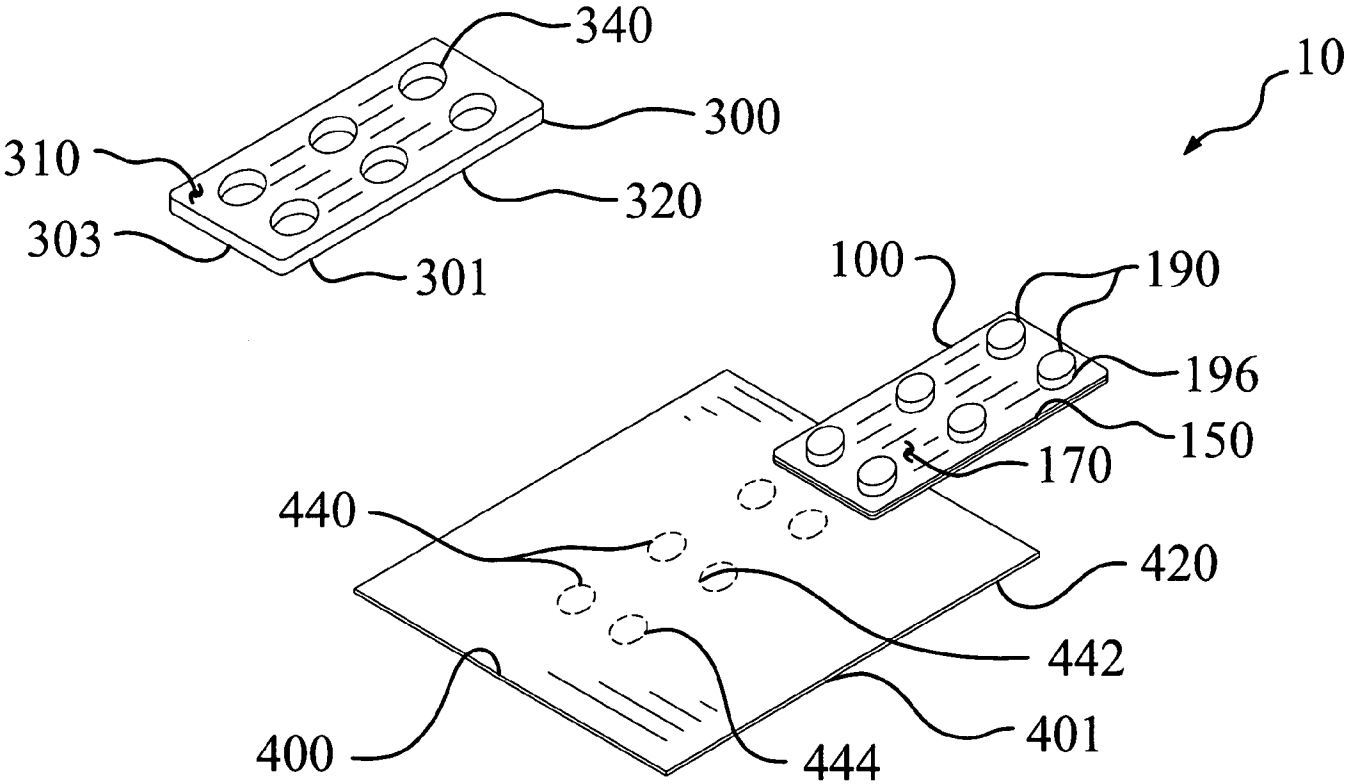
FIG. 2 is a perspective view of the components of the shielded child resistant medicament package, not to scale.
Figure 5:
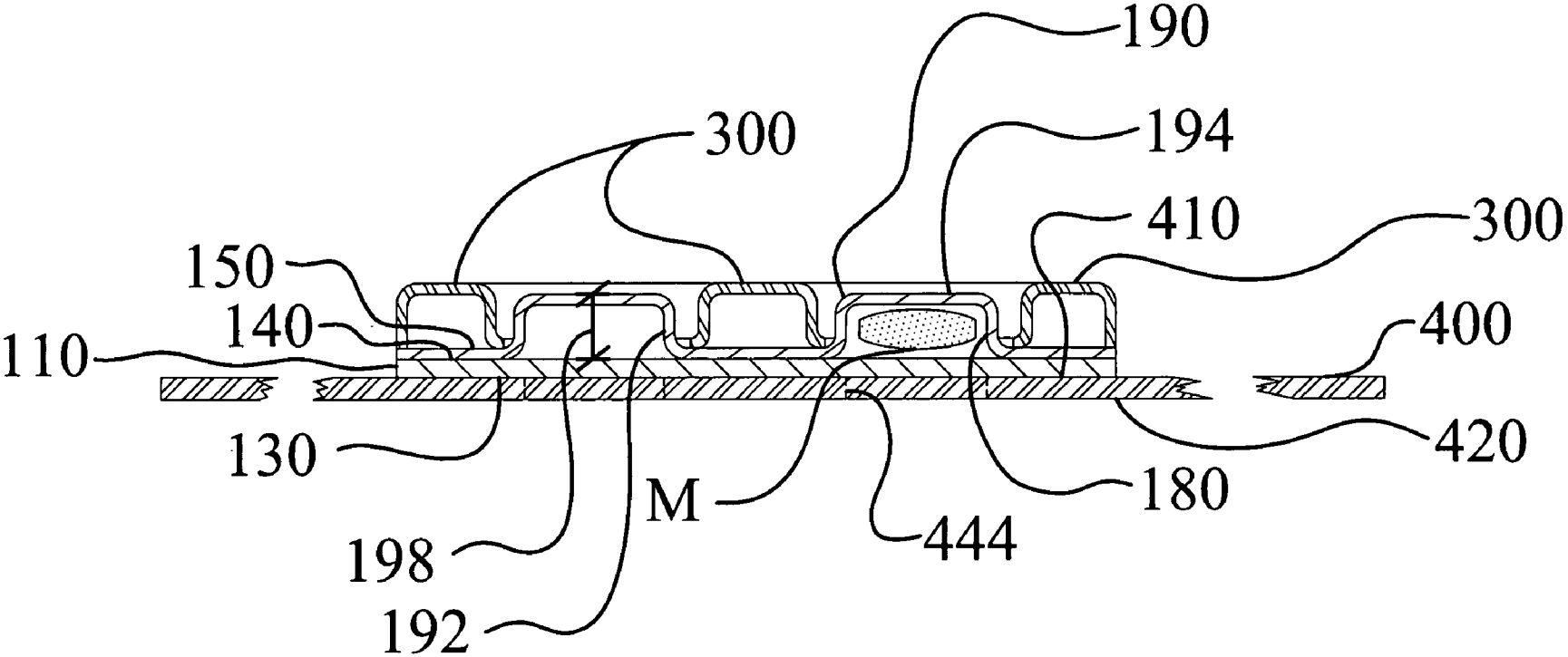
FIG. 5 is a cross-sectional view taken along section line 5-5 in FIG. 4 of the shielded child resistant medicament package, not to scale.

Second, referring to FIGS. 2 and 5, the blister shield (300) has a blister shield perimeter (301), a blister shield front surface (310), a blister shield rear surface (320), and is formed with a blister well (340). The blister well (340) is sized to generally cooperate with the article receiving blister (190) so that when the blister shield (300) is aligned with the blister portion (100) each blister well (340) is aligned with each article receiving blister (190). The blister well (340) is positioned such that it protects the article receiving blister side walls (192) by minimizing lateral forces from contacting these areas. As such, a substantially orthogonal force (F), seen in FIG. 11, must be applied to the article receiving blister end wall (194) in order to eject the medicament (M) from the article receiving blister (190). Additionally, in one embodiment, seen in FIG. 9, the blister shield (300) may be formed with the blister well (340) which has a well interior perimeter (342) including a well free edge (343) and a well sidewall (344). The functioning of the blister well (340) will be described later in greater detail.

Figure 9:
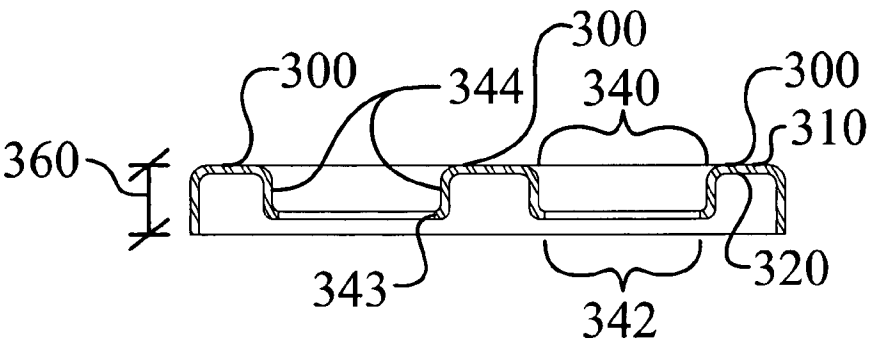
FIG. 9 is a cross-sectional view taken along section line 9-9 in FIG. 1 of a blister shield constructed of a formed film, not to scale.
Figure 13:
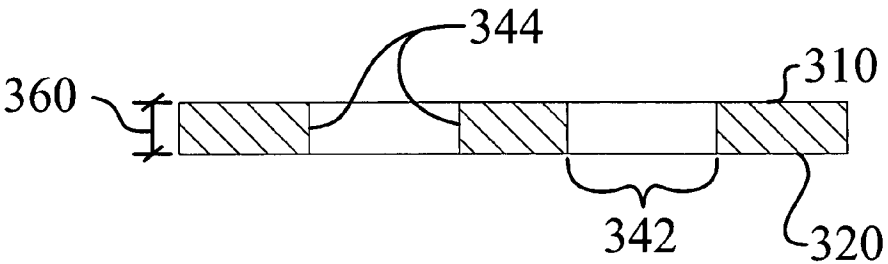
FIG. 13 is a cross-sectional view taken along section line 13-13 in FIG. 1 of a blister shield formed of a solid block, not to scale.

The blister shield (300) may be a sheet of material formed in any desired shape or it may be a solid layer, as shown in FIGS. 9 and 13, respectively. In one particular embodiment, the blister shield (300) is comprised of a material and thickness that cannot be readily torn, ruptured, or otherwise compromised by a human finger pushing or human teeth scraping on the blister shield (300). The material may be paper, or other fiber product, plastic, foil, or composite. Additionally, various embodiments of the invention may have different blister shield heights (360).

Figure 10:
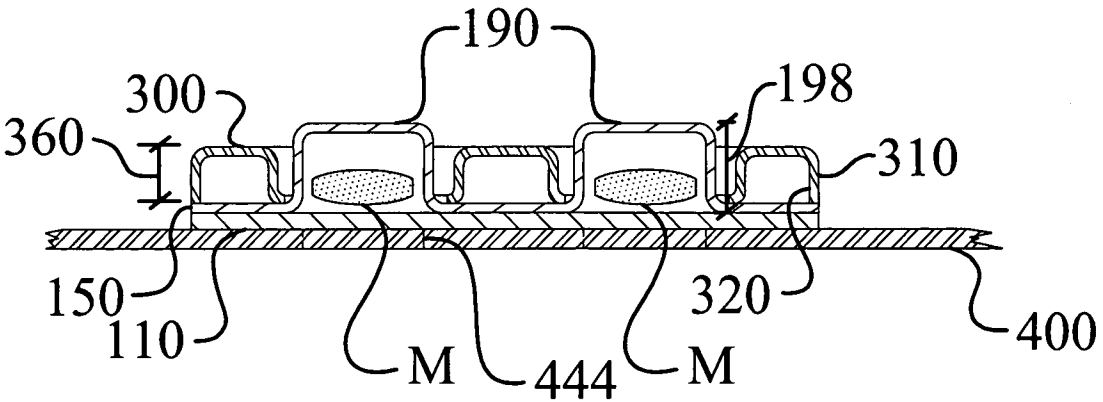
FIG. 10 is a cross-sectional view taken along section line 5-5 in FIG. 4 of the shielded child resistant medicament package with a blister shield having a blister shield height less than a blister height, not to scale.
Figure 11:
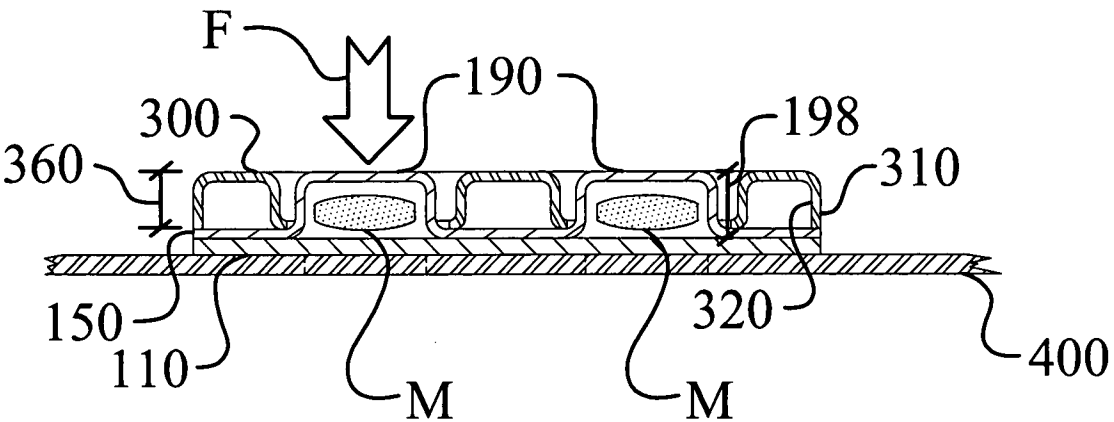
FIG. 11 is a cross-sectional view taken along section line 5-5 in FIG. 4 of the shielded child resistant medicament package with a blister shield having a blister shield height substantially the same as a blister height, not to scale.
Figure 12:
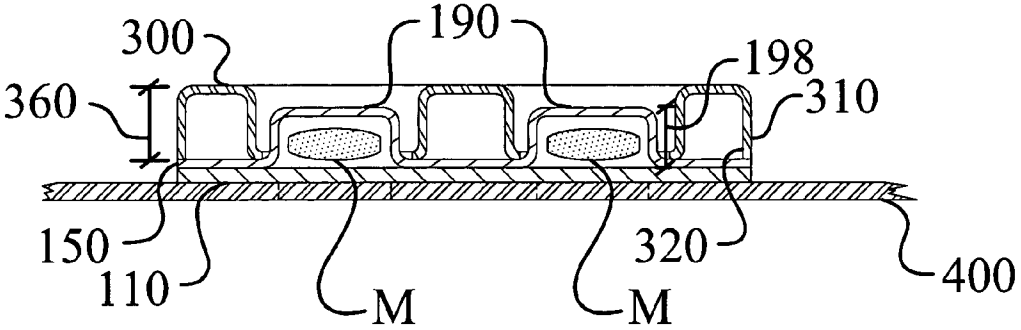
FIG. 12 is a cross-sectional view taken along section line 5-5 in FIG. 4 of the shielded child resistant medicament package with a blister shield having a blister shield height greater than a blister height, not to scale.

The blister shield height (360) is generally from 25% to 250% of the height of the blister height (198). However, in one embodiment, the blister shield height (360) may be from 75% to 125% of the height of the blister height (198) and in another embodiment, the blister shield height (360) may be substantially the same as the blister height (198), as shown in FIGS. 10-12. In the embodiment of the package (10) where the blister shield height (360) exceeds the blister height (198), as seen in FIG. 12, the blister shield (300) prevents substantially lateral forces from coming into contact with the article receiving blister (190). In another embodiment, shown in FIG. 11, the blister shield height (360) is substantially the same as the blister height (198). In this condition substantially lateral forces may or may not contact the article receiving blister (190); however, the portion of the article receiving blister (190) exposed, if any, is insufficient so that the applied force is not able to damage the article receiving blister (190). The remaining embodiment, with respect to the blister shield height (360) and the blister height (198), has the blister height (198) exceeding the blister shield height (360), as seen in FIG. 10. Lateral forces attacking the article receiving blister (190) are still unable to find sufficient surface to compromise the article receiving blister (190) to the extent that the medicament (M) is accessible.

Third, with reference to FIGS. 1 and 2, the shielded child resistant medicament package (10) includes a backing substrate (400) having a backing substrate perimeter (401), a backing substrate interior surface (410), and a backing substrate exterior surface (420). The backing substrate (400) is formed to have an article dispensing region (440).

Figure 8:
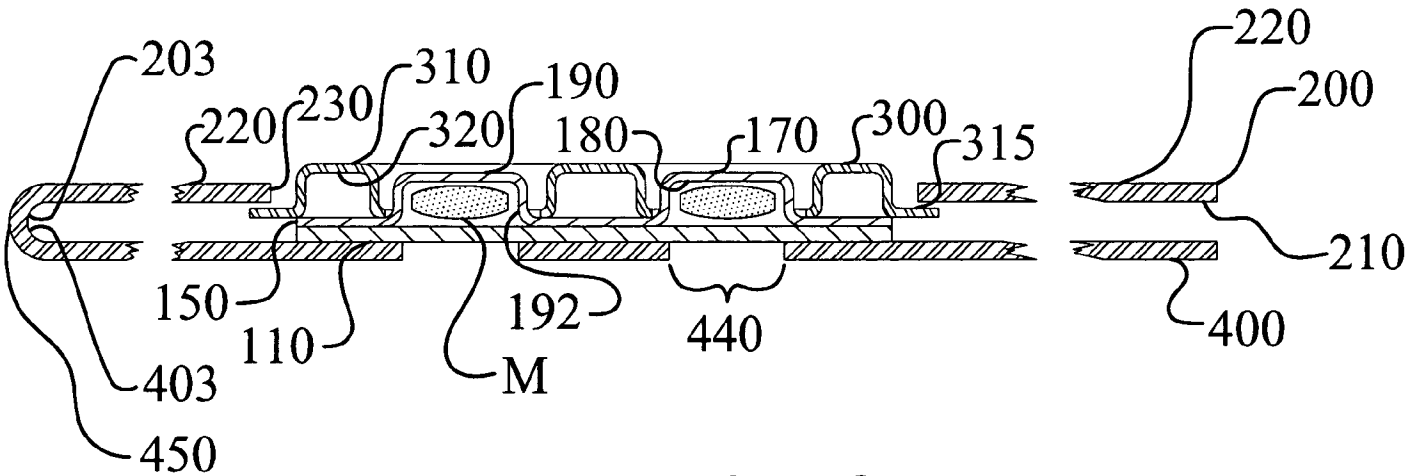
FIG. 8 is a cross-sectional view taken along section line 8-8 in FIG. 7 of the shielded child resistant medicament package, not to scale.

The article dispensing region (440) has an article dispensing region perimeter (442) and is configured to cooperate with the blister portion (100), as seen in FIG. 2. In other words, the article receiving blister (190) and the article dispensing region (440) must generally align such that when the medicament (M) is ejected from the article receiving blister (190), the medicament (M) may pass through the article dispensing region (440). In one embodiment, the article dispensing region (440) defines a void formed in the backing substrate (400) sized to cooperate with the medicament (M) so that the medicament (M) may pass through the article dispensing region (440) for distribution, as shown in FIG. 8.

Alternatively, the article dispensing region (440) may be an integral portion of the backing substrate (400) having a separation line (444), seen in FIG. 2, selectively reducing the strength of the backing substrate (400), thereby permitting the medicament (M) to break a portion of the article dispensing region (440) free of the backing substrate (400) along the separation line (444) when the medicament (M) is exposed to an ejection force, thus permitting the medicament (M) to pass through the article dispensing region (440) for distribution. In a further embodiment, the separation line (444) is located substantially on the article dispensing region perimeter (442). The separation line (444) need not be one continuous separation line (444) and may include one or more die cuts, perforations, indentations, score lines, and weakened fracture lines. As with the blister shield (300), in one particular embodiment the backing substrate (400) is comprised of a material and thickness that cannot be readily torn, ruptured, or otherwise compromised by a human finger picking at or human teeth biting or chewing the backing substrate (400). The material may be paper, or other fiber product, plastic, foil, or composite.

The assembly and orientation of the various elements of the package (10) imparts the desired functionality and child resistance of the shielded child resistant medicament package (10). The general assembly process is illustrated in FIGS. 1-4.

Figure 3:
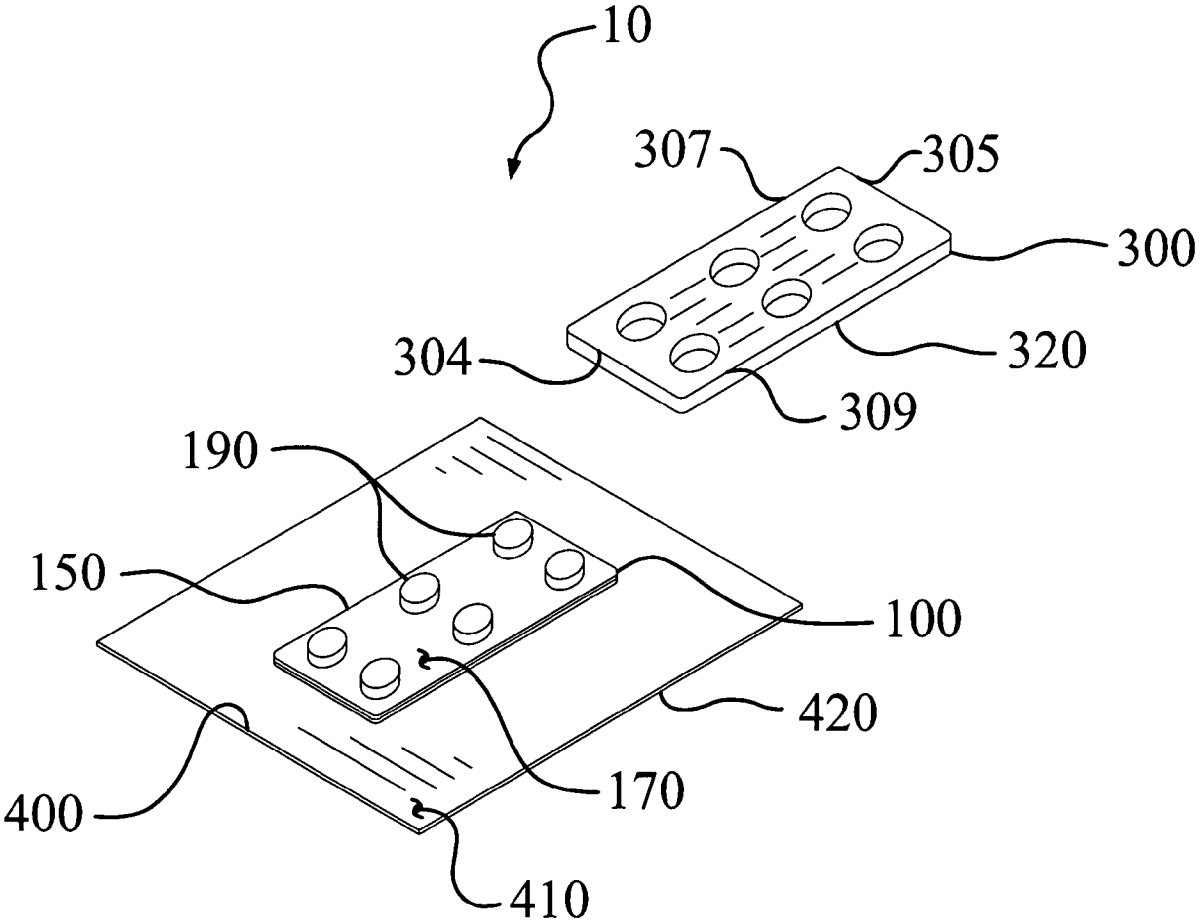
FIG. 3 is a perspective view of a partially assembled shielded child resistant medicament package, not to scale.

The blister portion (100) is located between the backing substrate (400) and the blister shield (300). In fact, the blister portion blister layer (150) is adjacent the blister shield rear surface (320) and the base layer exterior surface is adjacent to the backing substrate interior surface (410). As seen in FIGS. 2 and 3, the blister portion (100) is brought into proximity to the backing substrate (400) and placed so that the article receiving blisters (190) substantially align with the article dispensing region (440).

Figure 4:
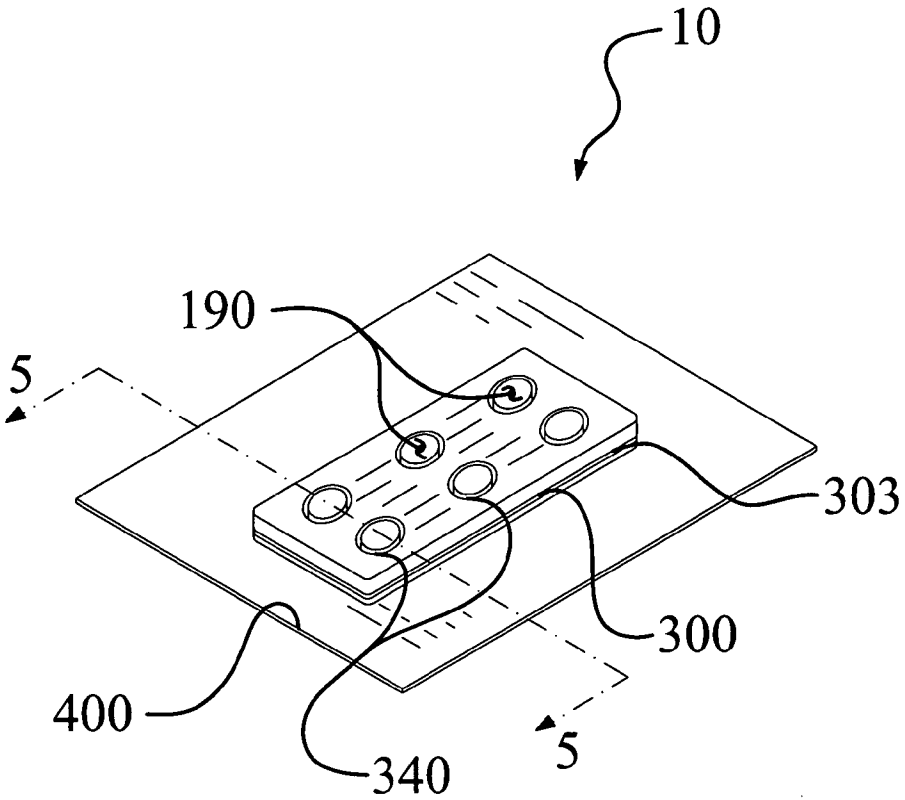
FIG. 4 is a perspective view of the assembled shielded child resistant medicament package, not to scale.

Once the blister portion (100) is in place, the blister shield (300) is brought into contact with the blister portion (100). In the embodiment of FIGS. 3 and 4, the blister shield (300) has a rectangular shape with a proximal edge (304), a distal edge (305), a sinistral edge (307), and a dextral edge (309). However, as one skilled in the art will recognize, the blister shield (300) can be circular, oval, or have any of a multitude of shapes having a complimentary number of edges. When the blister shield (300) is placed into the correct position against the blister portion (100), a blister shield support bearing edge (303) rests against the backing substrate interior surface (410), or the blister layer exterior surface (170), as seen in FIG. 5. As seen in FIG. 4, with reference as indicated in FIG. 4 and FIG. 5, each blister well (340) cooperates with each article receiving blister (190). The blister well (340) is located such that substantially all of each sidewall (192) is protected from substantially lateral forces by the blister shield (300) to prevent access to the medicament (M). The blister shield height (360) may be greater, substantially the same, or less than the blister height (198).

Figure 18:
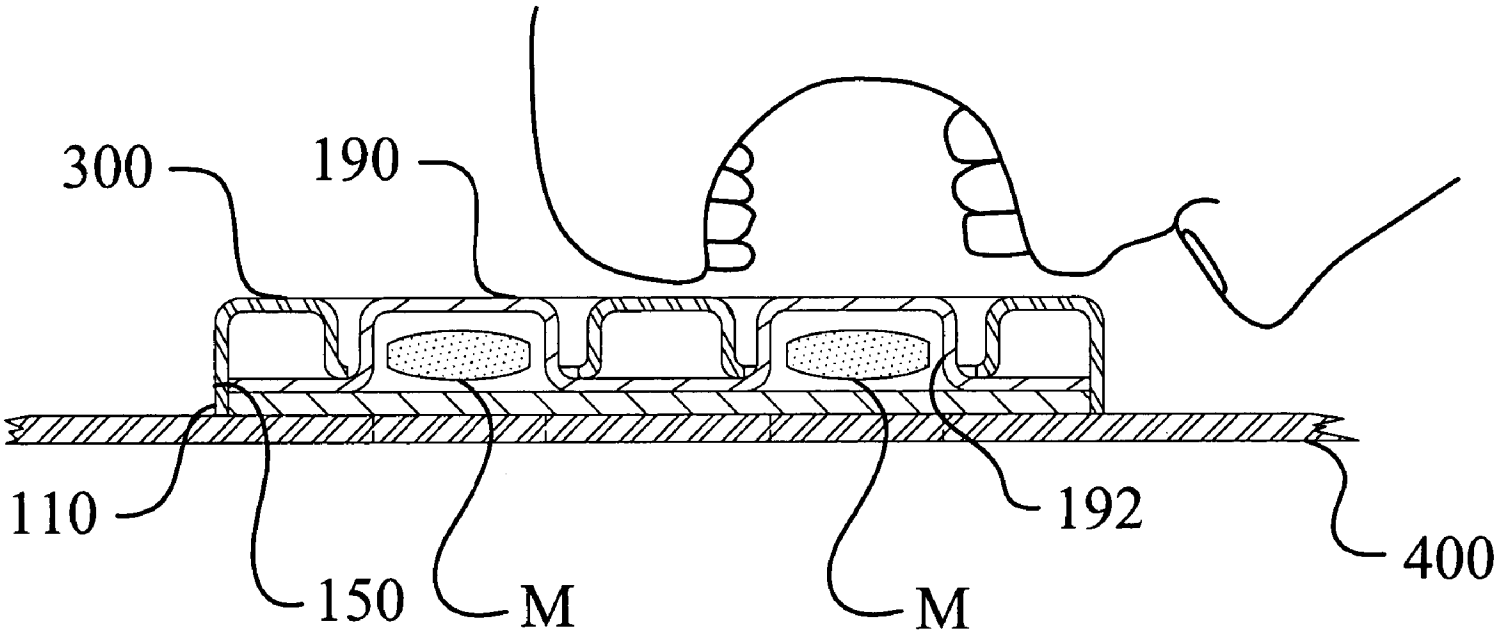
FIG. 18 is a cross-sectional view taken along section line 5-5 in FIG. 4 of the shielded child resistant medicament package, not to scale.

In an embodiment of the invention shown in FIGS. 8-12, the blister shield (300) is a sheet of material formed in a shape that protects the article receiving blister (190) from substantially lateral forces acting upon the sidewall (192). This result is achieved by designing the blister well (340) with the well sidewall (344) positioned so that, in the event of a force acting upon the blister shield front surface (310), the well free edge (343) engages or touches the blister layer exterior surface (170) preventing the blister shield (300) from being compressed to the point of allowing a significant portion of the article receiving blister (190) from projecting from the blister shield (300). Once the well free edge (343) is engaged, the well sidewall (344) deters any additional movement of the shield (300) that would expose the sidewall (192) to lateral forces. For example, a child who desires to bite the article receiving blister (190) will not be able to do so. This is because when the child presses his teeth against the blister shield (300) in an attempt to bite the article receiving blister (190), the shield will not move beyond the point that the well free edge (343) contacts the blister exterior surface (170) and none, or an insufficient portion, of the article receiving blister sidewall (192) will be exposed and the child's teeth will not be able to find a sufficient surface to damage the article receiving blister (190), as illustrated in FIG. 18.

Figure 6:
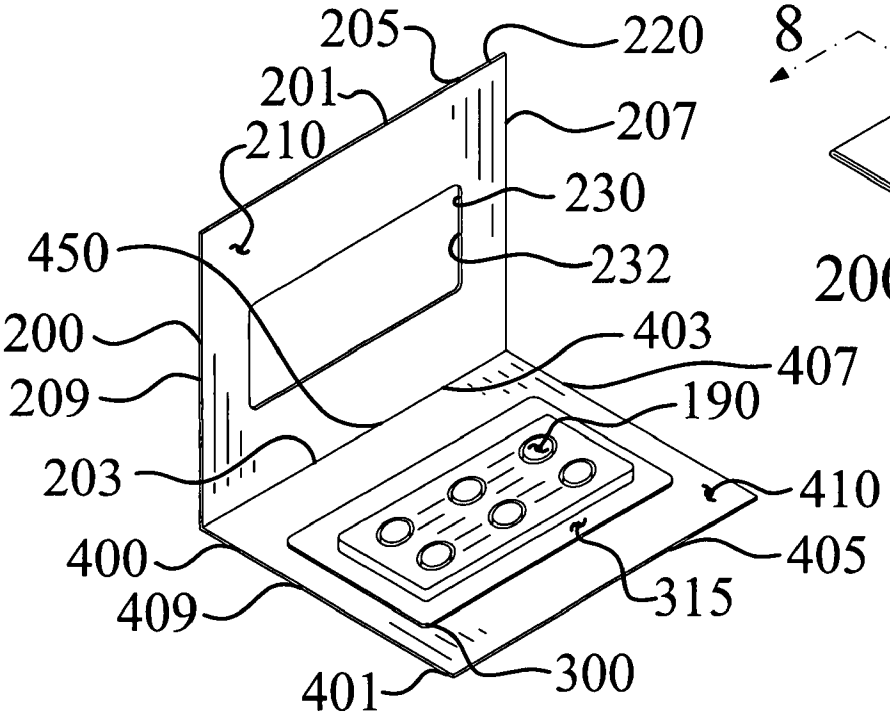
FIG. 6 is a perspective view of the shielded child resistant medicament package with an open dispensing substrate, not to scale.

A further embodiment, seen in FIG. 6, including a dispensing substrate (200) having a dispensing substrate perimeter (201), a dispensing substrate interior surface (210), and a dispensing substrate exterior surface (220). The dispensing substrate (200) is formed to have a dispensing substrate blister receiver (230) with a receiver perimeter (232). The dispensing substrate blister receiver (230) is sized to generally cooperate with the blister shield (300). The dispensing substrate blister receiver (230) is configured to cooperate with the blister portion (100) such that a portion of the article receiving blister (190) extends through the dispensing substrate (200) from the dispensing substrate interior surface (210) to the dispensing substrate exterior surface (220). This is illustrated best in FIG. 7 where the shielded child resistant medicament package (10) is shown with the dispensing substrate blister receiver (230) in the assembled configuration.

Figure 7:
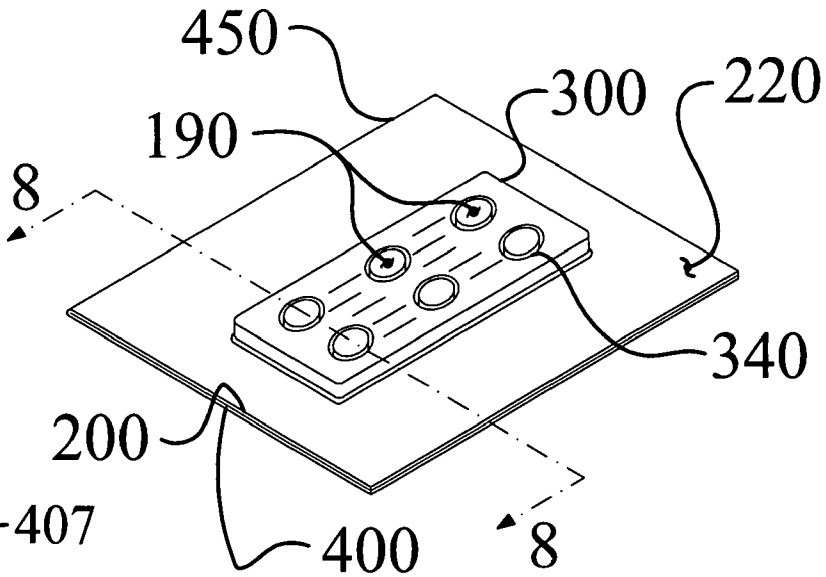
FIG. 7 is a perspective view of the shielded child resistant medicament package with the dispensing substrate closed, not to scale.

As shown in FIGS. 6 and 7, in the assembled configuration of one embodiment, both the dispensing substrate (200) and the backing substrate (400) are rectangular in shape. FIG. 6 is the open version while FIG. 7 is the closed version. With this configuration, the dispensing substrate (200) has a proximal edge (203), a distal edge (205), a sinistral edge (207), and a dextral edge (209). Similarly, the backing substrate (400) has a proximal edge (403), and distal edge (405), a sinistral edge (407), a fold line (450), and a dextral edge (409). As shown, the backing substrate perimeter (401) substantially aligns with the dispensing substrate perimeter (201). As one skilled in the art would appreciate, the dispensing substrate (200) and the backing substrate (400) need not be rectangular, nor do they need to be the same shape, in which case the individual substrate perimeters and edges may not align. Furthermore, the dispensing substrate (200) may have one of a multitude of shapes with an accompanying multitude of edges, and the backing substrate (400) may also have one of a multitude of shapes with an accompanying multitude of edges.

In the embodiment of FIG. 6, the blister shield (300) is formed with a blister shield flange (315). The blister shield flange (315) maybe captured between the dispensing substrate interior surface (210) and the blister portion (100). Alternatively, the blister shield flange (315) may be sandwiched between the backing substrate interior surface (410) and the dispensing substrate interior surface (210). In either case, the alignment of the dispensing substrate blister receiver (230), the blister shield (300) and the blister portion (100) cooperate to align the blister well (340) and the article dispensing blister (190) with the article dispensing region (440).

As with the backing substrate (400) and the blister shield (300), in one particular embodiment the dispensing substrate (200) is comprised of a material and thickness that cannot be readily torn, ruptured, or otherwise compromised by a human finger. The material may be paper, or other fiber product, plastic, foil, or composite.

In another embodiment, the shielded child resistant medicament package (10) includes a retaining substrate (500), as shown in FIGS. 14-17 generally. The retaining substrate (500) has a retaining substrate perimeter (501). Although the retaining substrate (500) may generally have a rectangular shape, in which case it has a retaining substrate proximal edge (503), a retaining substrate distal edge (505), a sinistral edge (507), and a retaining substrate dextral edge (509), it may have a variety of shapes and edge configurations. The retaining substrate (500) also has a retaining substrate interior surface (510), and a retaining substrate exterior surface (520). The retaining substrate (500) is formed with a retaining substrate blister receiver (530) having a retaining substrate blister receiver perimeter (532) that generally cooperates with the article receiving blister (190). In one embodiment, the article receiving blister (190) passes through the retaining substrate (500) from the retaining substrate blister interior surface (510) to the retaining substrate exterior surface (520) and substantially aligns the article receiving blister portion (190) with the article dispensing region (440).

Figure 16:
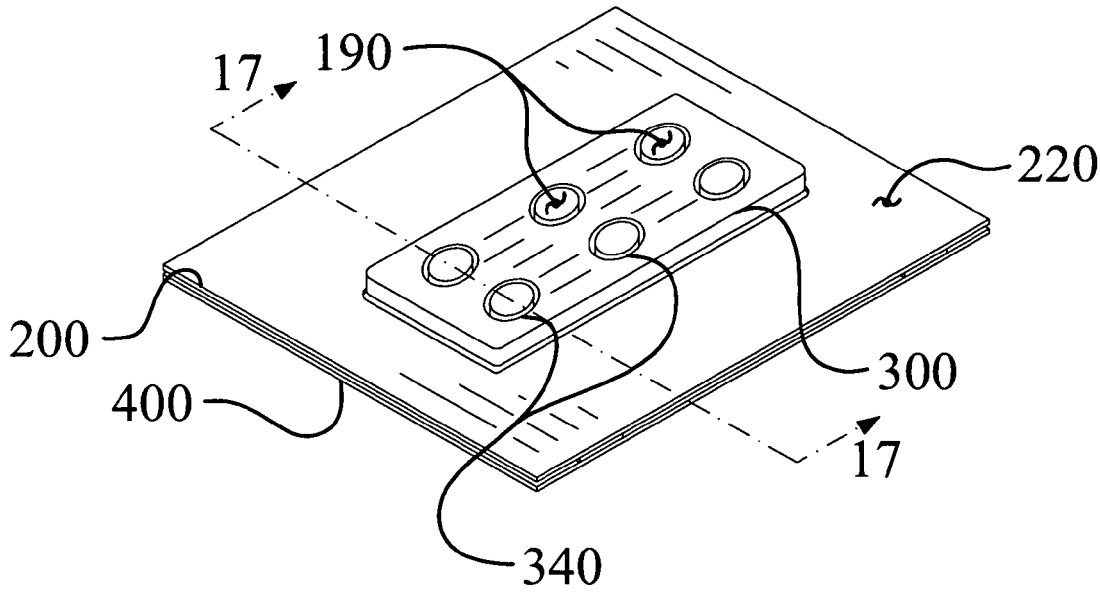
FIG. 16 is a perspective view of the shielded child resistant medicament package with a dispensing substrate and a retaining substrate, not to scale.
Figure 17:
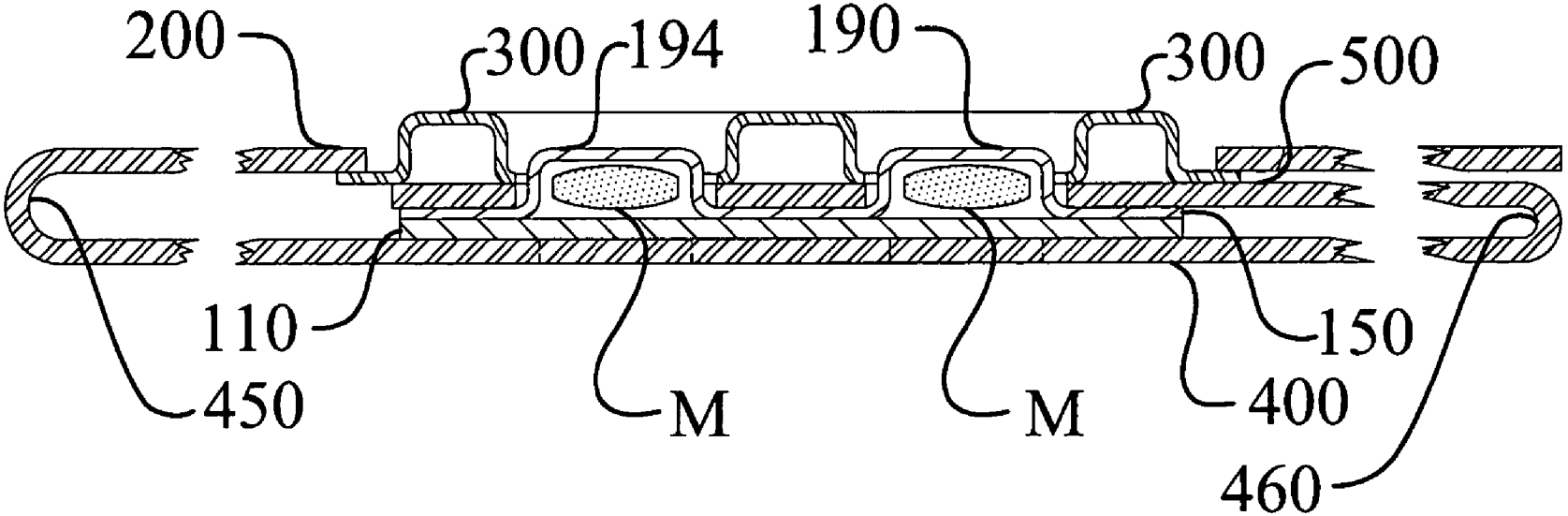
FIG. 17 is a cross-sectional view taken along section line 17-17 in FIG. 16 of the shielded child resistant medicament package with a dispensing substrate and a retaining substrate, not to scale.

When the package (10) is assembled, as shown in FIG. 16, the article receiving blister (190) passes through the retaining substrate (500) and cooperates with the blister well (340). The dispensing substrate (200) retains the blister shield (300) against the retaining substrate (500). A cross-sectional view of the embodiment shown in FIG. 16 is seen in FIG. 17. In this embodiment, with reference to FIGS. 14-17 generally, the package (10) is a layered structure where each layer is aligned with respect to each preceding layer to position the medicament (M) for dispensing through the article dispensing region (440) and to align the blister shield (300) with the blister portion (100). Proper alignment of the blister shield (300) is achieved when the article receiving blister (190) cooperates with the blister well (340). The package (10) is assembled by placing the blister portion (100), containing the medicament (M), onto the backing substrate (400). The retaining substrate (500) is folded over so that the retaining substrate blister receiver (530) cooperates with the article receiving blister (190) thus aligning the article receiving blister (190) with the article dispensing region (440). Once the retaining substrate (500) is in position, the blister shield (300), cooperating with the dispensing substrate (200), is brought into alignment with the article receiving blister (190).

Now, dispensing the medicament (M) from the package (10) requires application of a substantially orthogonal force within the blister shield well (340) to the article receiving blister end wall (194) resulting in pressure being exerted to the medicament (M) so that the base layer (110) ruptures and medicament (M) passes through the backing substrate dispensing region (440). Generally, the substantially orthogonal force will be applied by a tip of a human digit, most likely the thumb.

Figure 14:
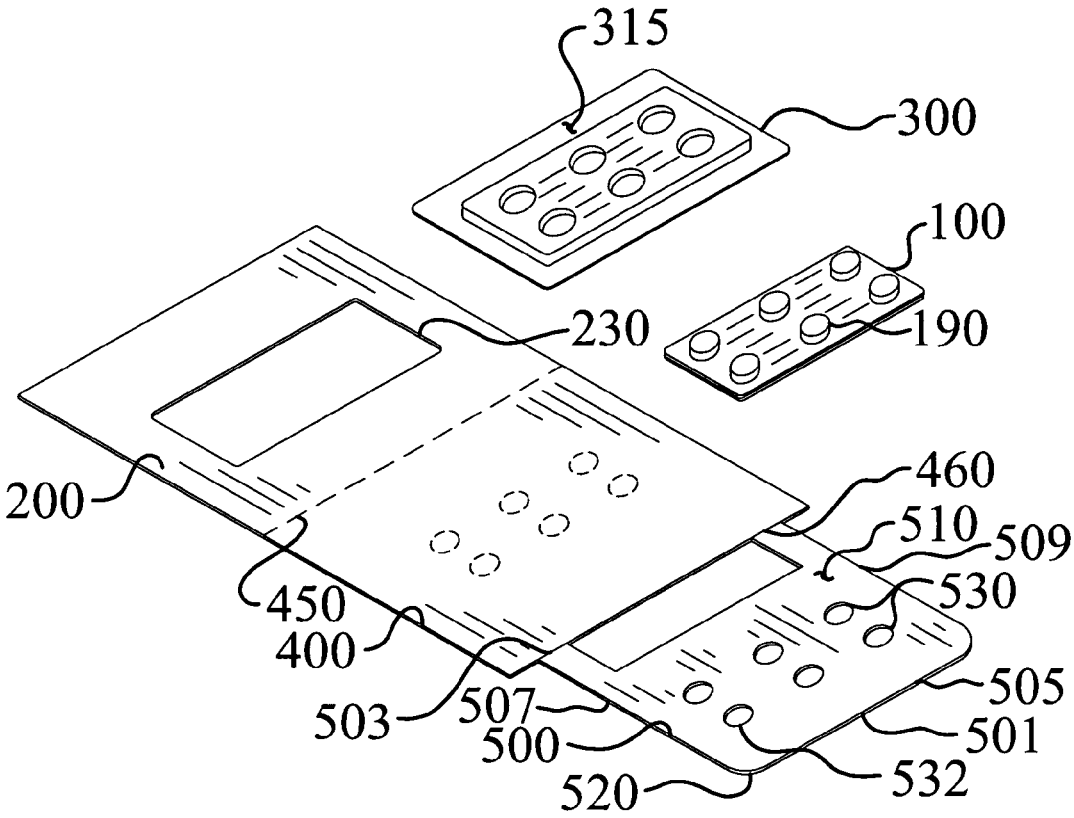
FIG. 14 is an exploded perspective view of the shielded child resistant medicament package with a dispensing substrate and a retaining substrate, not to scale.
Figure 15:
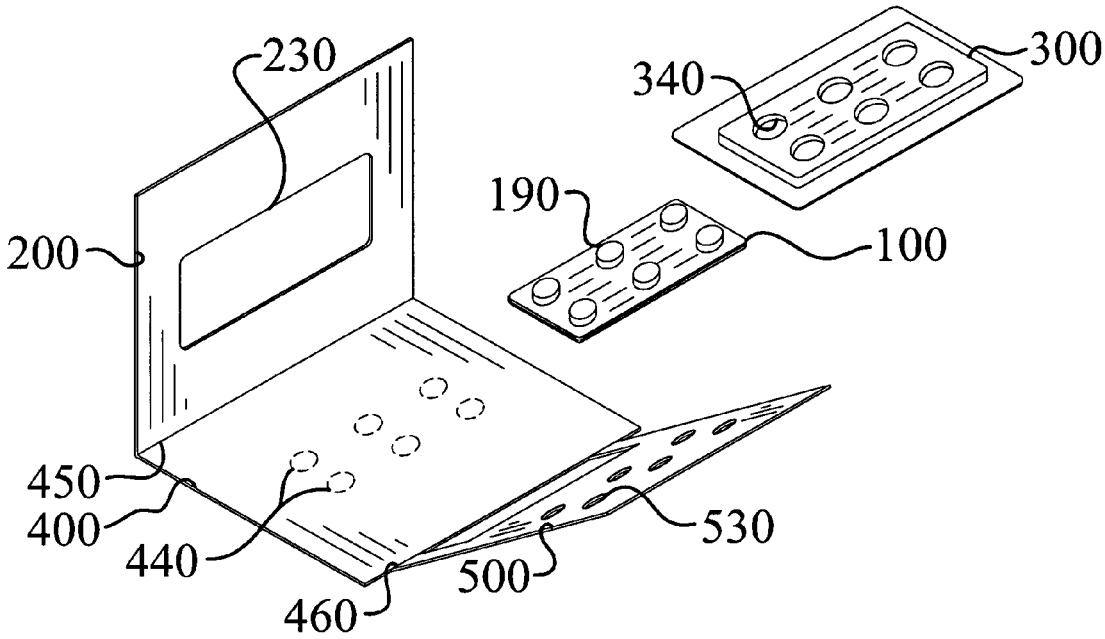
FIG. 15 is an exploded perspective view of the shielded child resistant medicament package with a dispensing substrate and a retaining substrate, not to scale.

The figures illustrate that each of these components may be separate and distinct elements that are joined together to create the shielded child resistant medicament package (10). However, the continuous substrate embodiments illustrated in FIGS. 6 and 14 are preferred for their high-speed manufacturing and assembly characteristics. Such characteristics include having predetermined fold locations between the various substrates (200, 400, 500) so that the blister well (340), the article dispensing region (440), and the article receiving blisters (190) are consistently and precisely placed in relation with one another to cooperate to achieve the desired sequence of operation. For example, the embodiment seen in FIG. 14 that includes the dispensing substrate (200), the backing substrate (400), and the retaining substrate (500), may be formed from a unitary sheet of material. In this case, a backing substrate dispensing fold line (450) and a backing substrate retainage fold line (460) will be formed in the unitary sheet. Each line (450,460) may include one or more die cuts, perforations, indentations, score lines, and weakened fold lines to ease assembly.

It should be noted that although the figures of the present application illustrate embodiments of the package (10) having six article receiving blisters (190), and therefore six blister wells (340), and six article dispensing regions (440), the present invention need only incorporate one of each of the previously listed elements, yet may incorporate hundreds of such elements.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

INDUSTRIAL APPLICABILITY

The shielded child resistant medicament package answers a long felt need for a novel package that is resistant to children, particularly those children that bite or those that have tenacious destructive character. In addition, there is a need for a package that retains its original aesthetic appeal after multiple medicaments have been removed from the package. The package is for use with small or large medicaments of various shapes. The present invention discloses a package that implements requiring the application of a substantially orthogonal force before the medicament can be dispensed, thereby avoiding some of the inherent problems of medication packages that use peeling to be opened. The package of the present invention is relatively easy for an adult to manipulate, but not easy for a child to access a medicament within the package.

We claim:

1. A medicament package (10) for housing a medicament (M), comprising:

(a) a blister portion (100) having:

(i) a base layer (110) having a base layer perimeter (120), a base layer exterior surface, and a base layer interior surface (140);

(ii) a blister layer (150) having a blister layer perimeter (160), a blister layer exterior surface (170), a blister layer interior surface (180), and including an article receiving blister (190), having a blister perimeter (196) and a blister height (198), formed therein, wherein the article receiving blister (190) is designed for holding the medicament (M); wherein (iii) at least five percent of the surface area of the base layer interior surface (140) is joined to the blister layer interior surface (180) thereby sealing the medicament (M) in the article receiving blister (190);

(b) a blister shield (300) having a blister shield height (360), a blister shield support bearing edge (303), a blister shield top surface (310), and a blister shield bottom surface (320), wherein the blister shield (300) is formed with a blister well (340) having a well interior perimeter (342) such that the blister well (340) cooperates with the article receiving blister (190);

(c) a backing substrate (400) having a backing substrate perimeter (401), a backing substrate interior surface (410), and a backing substrate exterior surface (420), wherein the backing substrate (400) is formed to have an article dispensing region (440) having an article dispensing region perimeter (442), wherein the article dispensing region (440) is configured to cooperate with the blister portion (100); and (d) wherein the blister portion (100) is located between the blister shield (300) and the backing substrate (400) such that the article receiving blister (190), the blister well (340), and the article dispensing region (440) substantially align and the blister well (340) cooperates with the article receiving blister (190) to shield, in part, the article receiving blister (190) from the application of lateral forces thereby requiring application of a substantially orthogonal force to the article receiving blister (190) to result in the medicament (M) breaking through the base layer (110), and passing out of the article dispensing region (440).

2. The medicament package (10) of claim 1, wherein the blister shield height (360) is between 25% of the blister height (198) and 250% of the blister height (198).

3. The medicament package (10) of claim 1, wherein the blister shield height (360) is between 75% of the blister height (198) and 125% of the blister height (198).

4. The medicament package (10) of claim 1, wherein the blister shield height (360) is substantially equal to the blister height (198).

5. The medicament package (10) of claim 1, further including a dispensing substrate (200) having a dispensing substrate perimeter (201), a dispensing substrate interior surface (210), and a dispensing substrate exterior surface (220), wherein the dispensing substrate (200) is formed to have a dispensing substrate blister receiver (230) configured to cooperate with the blister portion (100) and the blister shield (300) such that a portion of the article receiving blister (190) and a portion of the blister shield (300) extends through the dispensing substrate (200) from the dispensing substrate interior surface (210) to the dispensing substrate exterior surface (220), and the blister shield (300) has a blister shield flange (315) positioned between the dispensing substrate (200) and the backing substrate (400).

6. The medicament package (10) of claim 1, further including a retaining substrate (500) having a retaining substrate interior surface (510), a retaining substrate exterior surface (520), and a retaining substrate blister receiver (530) wherein the retaining substrate interior surface (510) is adjacent to the blister layer exterior surface (170) and a portion of the article receiving blister (190) extends through the retaining substrate blister receiver (530) from the retaining substrate interior surface (510) to the retaining substrate exterior surface (520), and wherein the blister shield support bearing edge (303) is adjacent to the retaining substrate exterior surface (520) such that the retaining substrate (500) retains and positions the blister portion (100) to ensure the article receiving blister (190), the blister well (340), and the article dispensing region (440) substantially align.

7. The medicament package (10) of claim 5, further including a retaining substrate (500) having a retaining substrate interior surface (510), a retaining substrate exterior surface (520), and a retaining substrate blister receiver (530) wherein the retaining substrate interior surface (510) is adjacent to the blister layer exterior surface (170) and a portion of the article receiving blister (190) extends through the retaining substrate blister receiver (530) from the retaining substrate interior surface (510) to the retaining substrate exterior surface (520) such that the retaining substrate (500) retains and positions the blister portion (100) to ensure the article receiving blister (190), the blister well (340), and the article dispensing region (440) substantially align.

8. The medicament package (10) of claim 7, wherein the dispensing substrate (200), the backing substrate (400), and the retaining substrate (500) are formed of a single substrate folded about a backing substrate dispensing fold line (450) and a backing substrate retainage fold line (460).

9. The medicament package (10) of claim 1, wherein the backing substrate article dispensing region (440) defines a void formed in the backing substrate (400) sized to cooperate with the medicament (M) so that the medicament (M) may pass through the article dispensing region (440) for distribution.

10. The medicament package (10) of claim 1, wherein the backing substrate article dispensing region (440) is an integral portion of the backing substrate (400) having a separation line (444) selectively reducing the strength of the backing substrate (400), thereby permitting the medicament (M) to break a portion of the article dispensing region (440) free of the backing substrate (400) along the separation line (444) when the medicament (M) is exposed to an orthogonal force, thereby permitting the medicament (M) to pass through the article dispensing region (440) for distribution.

11. The medicament package (10) of claim 10, wherein the separation line (444) is located substantially on the article dispensing region perimeter (442).

12. The medicament package (10) of claim 11, wherein the separation line (444) comprises one or more of the group consisting of die cuts, perforations, indentations, score lines, and weakened fracture lines.

13. The medicament package (10) of claim 1, wherein the blister shield (300) is comprised of a material and thickness that cannot be readily deformed by a human finger pushing adjacent to the article receiving blister (190) thereby preventing exposure of the article receiving blister (190) to the application of substantially lateral forces and thus limiting access to the medicament (M) via compromise of the article receiving blister (190).

14. The medicament package (10) of claim 1, further including a well sidewall (344) and a well free edge (343) such that application of orthogonal force to the blister shield (300) adjacent to the article receiving blister (190) causes the well free edge (343) to contact the blister layer exterior surface (170) and whereby the well sidewall (344) reduces exposure of the article receiving blister (190) to the application of lateral forces and thus limits access to the medicament (M) via compromise of the article receiving blister (190).

15. The medicament package (10) of claim 1, wherein the blister well (340) is sized to cooperate with the dimensions of a tip of a human finger.

16. A medicament package (10) for housing a medicament (M), comprising:

(a) a blister portion (100) having:

(i) a base layer (110) having a base layer perimeter (120), a base layer exterior surface, and a base layer interior surface (140);

(ii) a blister layer (150) having a blister layer perimeter (160), a blister layer exterior surface (170), a blister layer interior surface (180), and including an article receiving blister (190), having a blister perimeter (196) and a blister height (198), formed therein, wherein the article receiving blister (190) is designed for holding the medicament (M); wherein (iii) at least five percent of the surface area of the base layer interior surface (140) is joined to the blister layer interior surface (180) thereby sealing the medicament (M) in the article receiving blister (190);

(b) a blister shield (300) having a blister shield support bearing edge (303), a blister shield top surface (310), a blister shield bottom surface (320), a blister well (340), and a blister shield height (360); wherein (i) the blister well (340) is sized to cooperate with the dimensions of a tip of a human finger;

(ii) the blister shield height (360) is between 75% of the blister height (198) and 125% of the blister height (198);

(c) a backing substrate (400) having a backing substrate perimeter (401), a backing substrate interior surface (410), and a backing substrate exterior surface (420), wherein the backing substrate (400) is formed to have an article dispensing region (440) having an article dispensing region perimeter (442), wherein the article dispensing region (440) is configured to cooperate with the blister portion (100); and (d) wherein the blister portion (100) is located between the blister shield (300) and the backing substrate (400) such that the article receiving blister (190), the blister well (340), and the article dispensing region (440) align and the blister well (340) cooperates with the article receiving blister (190) to shield the article receiving blister (190) from the application of lateral forces thereby limiting access to the medicament (M) via compromise of the article receiving blister (190) and requiring application of a orthogonal force to the article receiving blister (190) to result in the medicament (M) breaking through the base layer (110), and passing out of the article dispensing region (440).

17. The medicament package (10) of claim 16, wherein the blister shield height (360) is substantially equal to the blister height (198).

18. The medicament package (10) of claim 16, further including a dispensing substrate (200) having a dispensing substrate perimeter (201), a dispensing substrate interior surface (210), and a dispensing substrate exterior surface (220), wherein the dispensing substrate (200) is formed to have a dispensing substrate blister receiver (230) configured to cooperate with the blister portion (100) and the blister shield (300) such that a portion of the article receiving blister (190) and a portion of the blister shield (300) extends through the dispensing substrate (200) from the dispensing substrate interior surface (210) to the dispensing substrate exterior surface (220), and the blister shield (300) has a blister shield flange (315) positioned between the dispensing substrate (200) and the backing substrate (400).

19. The medicament package (10) of claim 16, further including a retaining substrate (500) having a retaining substrate interior surface (510), a retaining substrate exterior surface (520), and a retaining substrate blister receiver (530) wherein the retaining substrate interior surface (510) is adjacent to the blister layer exterior surface (170) and a portion of the article receiving blister (190) extends through the retaining substrate blister receiver (530) from the retaining substrate interior surface (510) to the retaining substrate exterior surface (520), and wherein the blister shield support bearing edge (303) is adjacent to the retaining substrate exterior surface (520) such that the retaining substrate (500) retains and positions the blister portion (100) to ensure the article receiving blister (190), the blister well (340), and the article dispensing region (440) align.

20. The medicament package (10) of claim 18, further including a retaining substrate (500) having a retaining substrate interior surface (510), a retaining substrate exterior surface (520), and a retaining substrate blister receiver (530) wherein the retaining substrate interior surface (510) is adjacent to the blister layer exterior surface (170) and a portion of the article receiving blister (190) extends through the retaining substrate blister receiver (530) from the retaining substrate interior surface (510) to the retaining substrate exterior surface (520) such that the retaining substrate (500) retains and positions the blister portion (100) to ensure the article receiving blister (190), the blister well (340), and the article dispensing region (440) substantially align.

21. The medicament package (10) of claim 20, wherein the dispensing substrate (200), the backing substrate (400), and the retaining substrate (500) are formed of a single substrate folded about a backing substrate dispensing fold line (450) and a backing substrate retainage fold line (460).

22. The medicament package (10) of claim 16, wherein the backing substrate article dispensing region (440) defines a void formed in the backing substrate (400) sized to cooperate with the medicament (M) so that the medicament (M) may pass through the article dispensing region (440) for distribution.

23. The medicament package (10) of claim 16, wherein the backing substrate article dispensing region (440) is an integral portion of the backing substrate (400) having a separation line (444) selectively reducing the strength of the backing substrate (400), thereby permitting the medicament (M) to break a portion of the article dispensing region (440) free of the backing substrate (400) along the separation line (444) when the medicament (M) is exposed to an orthogonal force, thereby permitting the medicament (M) to pass through the article dispensing region (440) for distribution.

24. The medicament package (10) of claim 23, wherein the separation line (444) is located substantially on the article dispensing region perimeter (442).

25. The medicament package (10) of claim 24, wherein the separation line (444) comprises one or more of the group consisting of die cuts, perforations, indentations, score lines, and weakened fracture lines.

26. The medicament package (10) of claim 16, further including a well sidewall (344) and a well free edge (343) such that application of orthogonal force to the blister shield (300) adjacent to the article receiving blister (190) causes the well free edge (343) to contact the blister layer exterior surface (170) and whereby the well sidewall (344) reduces exposure of the article receiving blister (190) to the application of lateral forces and thus prevents access to the medicament (M) via compromise of the article receiving blister (190).

27. The child medicament package (10) of claim 16, wherein the blister well (340) is sized to cooperate with the dimensions of a tip of a human finger.

28. A medicament package (10) for housing a medicament (M), comprising:

(a) a blister portion (100) having:

(i) a base layer (110) having a base layer perimeter (120), a base layer exterior surface, and a base layer interior surface (140);

(ii) a blister layer (150) having a blister layer perimeter (160), a blister layer exterior surface (170), a blister layer interior surface (180), and including an article receiving blister (190), having a blister perimeter (196) and a blister height (198), formed therein, wherein the article receiving blister (190) is designed for holding the medicament (M); wherein (iii) at least five percent of the surface area of the base layer interior surface (140) is joined to the blister layer interior surface (180) thereby sealing the medicament (M) in the article receiving blister (190);

(b) a dispensing substrate (200) having a dispensing substrate perimeter (201), a dispensing substrate interior surface (210), a dispensing substrate exterior surface (220), and the dispensing substrate (200) is formed to have a dispensing substrate blister receiver (230);

(c) a blister shield (300) having a blister shield support bearing edge (303), a blister shield top surface (310), a blister shield bottom surface (320), a blister well (340), and a blister shield height (360); wherein (i) the blister well (340) is formed with a well interior perimeter (342) such that the blister well (340) cooperates with the article receiving blister (190); and wherein (ii) the blister shield height (360) is substantially equal to the blister height (198);

(d) a backing substrate (400) having a backing substrate perimeter (401), a backing substrate interior surface (410), and a backing substrate exterior surface (420), wherein the backing substrate (400) is formed to have an article dispensing region (440) having an article dispensing region perimeter (442), wherein the article dispensing region (440) is configured to cooperate with the blister portion (100);

(e) a retaining substrate (500) having a retaining substrate interior surface (510), a retaining substrate exterior surface (520), and a retaining substrate blister receiver (530) that is designed to cooperate with the blister portion (100); and (f) wherein the blister portion (100) lies between the backing substrate (400) and the retaining substrate (500) with the blister shield (300) held in place by the dispensing substrate (200), and wherein the article receiving blister (190), the blister well (340), and the article dispensing region (440) align and the blister well (340) cooperates with the article receiving blister (190) to shield, in part, the article receiving blister (190) from the application of lateral forces thereby preventing access to the medicament (M) via compromise of the article receiving blister (190) and requiring application of a orthogonal force to the article receiving blister (190) to result in the medicament (M) breaking through the base layer (110), and passing out of the article dispensing region (440).

* * * * *

UNITED STATES PATENT AND TRADEMARK OFFICE

CERTIFICATE OF CORRECTION

PATENT NO. : 7,331,460 B2
APPLICATION NO. : 11/325364
DATED : February 19, 2008
INVENTOR(S) : David R. Barndt et al.

It is certified that error appears in the above-identified patent and that said Letters Patent is hereby corrected as shown below:

COLUMN 2

Line 54, “imparts” should read --impart--.

COLUMN 3

Line 3, “surface” should read --surface; and--; and
Line 45, “surface” should read --surface; and--.

COLUMN 4

Line 17, “fro” should read --from--.

COLUMN 7

Line 67, “imparts” should read --impart--.

COLUMN 9

Line 30, “maybe” should read --may be--.

COLUMN 11

Line 33, “surface (140);” should read --surface (140); and--.

COLUMN 13

Line 44, “surface (140);” should read --surface (140); and--.
Line 61, “finger;” should read --finger; and--.

COLUMN 14

Line 15, “a” should read --an--.

COLUMN 15

Line 36, “child” should be deleted; and
Line 44, “surface (140);” should read --surface (140); and--.

UNITED STATES PATENT AND TRADEMARK OFFICE

CERTIFICATE OF CORRECTION

PATENT NO. : 7,331,460 B2
APPLICATION NO. : 11/325364
DATED : February 19, 2008
INVENTOR(S) : David R. Barndt et al.

It is certified that error appears in the above-identified patent and that said Letters Patent is hereby corrected as shown below:

COLUMN 16

Line 45, "a" should read --an--.

Signed and Sealed this

Thirtieth Day of September, 2008

JON W. DUDAS
*Director of the United States Patent and Trademark Office*